US005786889A

United States Patent [19]

Pope et al.

[11] Patent Number: 5,786,889

[45] Date of Patent: Jul. 28, 1998

[54] METHOD OF MONITORING COALIGNMENT OF A SIGHTING OR SURVEILLANCE SENSOR SUITE

[75] Inventors: Stephen John Pope, Colwyn Bay; Grahame Stewart Crook, Rhyl, both of Wales

[73] Assignee: Pilkington P E Limited, Wales, United Kingdom

[21] Appl. No.: 545,782

[22] PCT Filed: May 11, 1994

[86] PCT No.: PCT/GB94/01010

§ 371 Date: Nov. 9, 1995

§ 102(e) Date: Nov. 9, 1995

[87] PCT Pub. No.: WO94/27108

PCT Pub. Date: Nov. 24, 1994

[30] Foreign Application Priority Data

May 12, 1993 [GB] United Kingdom ..... 9309750

[51] Int. Cl.[6] ..... G01J 5/02; G01B 11/26

[52] U.S. Cl. ..... 356/152.1; 250/342; 356/153; 356/141.1

[58] Field of Search ..... 356/4.01, 5.01, 356/5.15, 141.1, 152.1, 152.3, 138, 153

[56] References Cited

U.S. PATENT DOCUMENTS

| | | |
|---|---|---|
| 4,091,412 | 5/1978 | Salonimer . |
| 4,422,758 | 12/1983 | Godfrey et al. . |
| 5,291,263 | 3/1994 | Kong . |

FOREIGN PATENT DOCUMENTS

| | | |
|---|---|---|
| 0160334 | 11/1985 | European Pat. Off. . |
| 0419320 | 3/1991 | European Pat. Off. . |
| 3439273 | 11/1985 | Germany . |
| 2165957 | 4/1986 | United Kingdom . |
| 8706774 | 11/1987 | WIPO . |
| 9208944 | 5/1992 | WIPO . |

*Primary Examiner*—Stephen C. Buczinski
*Attorney, Agent, or Firm*—Bell Seltzer Park

[57] ABSTRACT

A method of monitoring the coalignment of a sighting or surveillance sensor suite including a coaligned laser (18) and sensor (12) includes the steps of: modifying the beam from the laser (18) to render it visible to the sensor (12); and redirecting the modified beam from the laser (18) to impinge on the sensor (12). In the preferred embodiments the frequency of the beam is doubled by a doubling crystal. For certain lasers this renders the beam visible to the human eye, or to a camera.

12 Claims, 2 Drawing Sheets

METHOD OF MONITORING COALIGNMENT OF A SIGHTING OR SURVEILLANCE SENSOR SUITE

This invention relates to a method of monitoring the coalignment of a sighting or surveillance sensor suite including a laser and a sensor coaligned with the laser bean. The invention also relates to apparatus for monitoring the coalignment of a sensor suite.

Modern military sighting and surveillance sensor suites are often required to have accurate coalignment of the sensors within the system and, in such cases where weapons are to be aimed or guided, to the point of impact of the weapon. Coalignment is achieved by one of several methods: the system may be factory set and coalignment retained by design; or in the case of a gun or rocket, the aiming device may be set by firing several practice rounds and adjusting the sighting system point of reference to the point of impact.

Maintaining alignment in a factory set system tends to result in over engineering of the aiming system to achieve the necessary long term stability, leading to cost and size/weight penalties. Also, an assumption that factory coalignment settings have been retained may result in problems and, in the case of a weapon system, the user is unable to determine how accurate his shot will be until he engages a target. The impact on a surveillance system may not be as immediate, but relying on inaccurate target location data could have serious repercussions.

Adjustment to sighting systems through monitoring the point of impact of practice rounds allows coalignment to be checked, though of course this involves the deployment of ordinance. This requires provision of a safe clear area in which coalignment tests can be conducted, and may be time consuming, precluding use in theatre. Also, if the ordinance is costly, such as missiles or smart bombs, then such trials are economically unacceptable. Further, this form of trial requires the operator to possess a considerable degree of skill to adjust the system and provide a subjective assessment of the error between the intended target and the actual point of impact of the projectile.

Increasingly, a greater number of weapons are laser guided, or have targets illuminated by laser designators, and these systems depend heavily on high accuracy sensor coalignment. In such systems, the laser is the system reference and it is to the laser beam that the other sensors are coaligned.

One of the most popular lasers currently in use is the Nd:YAG laser. Lasers of this type are compact, solid state lasers emitting at 1064 nm. They are capable of producing good energy output (500 mj), at high repetition rates (20 HZ and over), for typically, 15 ns pulse durations. However, in direct view sighting systems it is impossible to show the user the path of the laser in order to effect coalignment because not only is 1064 nm radiation invisible to the human eye, but can also cause serious eye damage.

Another difficulty in utilising laser based sighting or surveillance sensor suites is that, as mentioned above, the most popular lasers can potentially cause serious eye damage. However, the requirement to train military personnel in the operation of laser based weapons systems in as near real situation as possible requires use of such systems in exercises. To minimise the possibility of eye damage eye-safe lasers have been developed for training purposes. The most popular wavelength of eye-safe laser operation is 1540 nm, as produced by erbium glass lasers. However, in a sighting system utilising CCD TV cameras it is not possible to produce a coalignment checking system using 1540 nm energy direct onto the CCD as silicon, the basis for current CCD camera detectors, does not absorb 1540 nm photons and therefore has no response to this wavelength.

A number of techniques have been used to render lasers "visible" to such sensors, and the human eye, the most popular of which relies on focusing the laser onto a target formed of a material which absorbs the laser energy and ablates to produce a visible spot. However, there are a number of problems associated with such a system. Firstly, as the target ablates, it has a limited lifespan and ultimately it must be replaced, though its lifespan may be extended by employing a mechanical shifting device to move the material and make maximum use of the target surface. Secondly, the visible laser spot tends not to be well defined. There are a number of factors which contribute to this: the heating process causes an irregular plasma cloud to form above the material surface; the spot defocusses as the surface is eroded; irregular ablation occurs because of faults in the material and features such as crystal grain lines; and the ablation material reacts differently to each subsequent laser shot due to residual effects of the previous shots.

One of these systems is disclosed in GB-A-2165957A for use with aiming apparatus including a laser and a thermal imager. Coalignment checking apparatus contained within a housing is positioned in front of the aiming apparatus. The beam from the laser passes into the housing and is directed to a concave mirror which focuses the laser energy on a body which is then heated to give off thermal radiation. This thermal radiation is reflected and collimated by the concave mirror into a beam parallel to the laser sightline and within the field of view of the thermal imager. WO-A-87 06774 discloses a laser system for producing a frequency-doubled CW laser input beam. The system includes an Nd:YAG laser and a KTP frequency-doubling crystal.

It is among the objects of the present invention to provide an improved method and apparatus for use in monitoring the coalignment of a sighting or surveillance sensor suite including a laser and a sensor.

According to the present invention there is provided method of monitoring the coalignment of a sighting or surveillance sensor suite including a laser and sensor which are coaligned such that the image created by the beam from the laser impinging on an object is viewed by the sensor, the method comprising the steps of: doubling the frequency of the beam from the laser to produce a modified beam which is itself directly visible to the sensor, and redirecting the modified beam to impinge on the sensor.

The sensor may be an optical sensor or a CCD camera, or form part of a direct view sighting system. The laser may be one utilised for range finding, target designation and the like. In addition to use in military systems, the method may also be employed in laser ranging surveying equipment and the like.

For use in a direct view sighting system utilising an Nd:YAG laser, frequency doubling renders the light visible to the human eye and, if the intensity of the modified laser is reduced, also renders the laser beam nonharmful to the eye. Further, the resulting 532 nm wavelength energy is at the peak response of the eye. Thus, adjustment of coalignment is possible by directing the modified beam directly into the sighting system. For use in a CCD camera system utilising an erbium glass laser, frequency doubling renders the modified beam visible when directed into the camera and the resulting 770 nm radiation is, approximately, at the peak response of silicon-based CCD cameras. Thus, it may be seen that the present invention facilitates coalignment checking in a variety of laser based systems.

Preferably also, the method includes the further step of correcting the alignment of the laser beam and the sensor if the visible beam is found to be out of alignment with the sensor: for example, the laser beam may be moved using steerable optical elements; an aiming reference image may be moved with respect to the outside world scene; or, in the case of a computerised system, the alignment error may be entered into the computer for automatic compensation.

According to a further aspect of the present invention there is provided apparatus for monitoring the coalignment of a sighting or surveillance suite including a laser and a sensor which are coaligned such that the image created by the beam from the laser impinging on an object is viewed by the sensor, the apparatus comprising: means for redirecting the beam from the laser to impinge on the sensor; and means for doubling the frequency of the redirected beam to produce a modified beam which is itself directly visible to the sensor.

These and other aspects of the present invention will now be described, by way of example, with reference to the accompanying drawings, in which.

Figure 1:
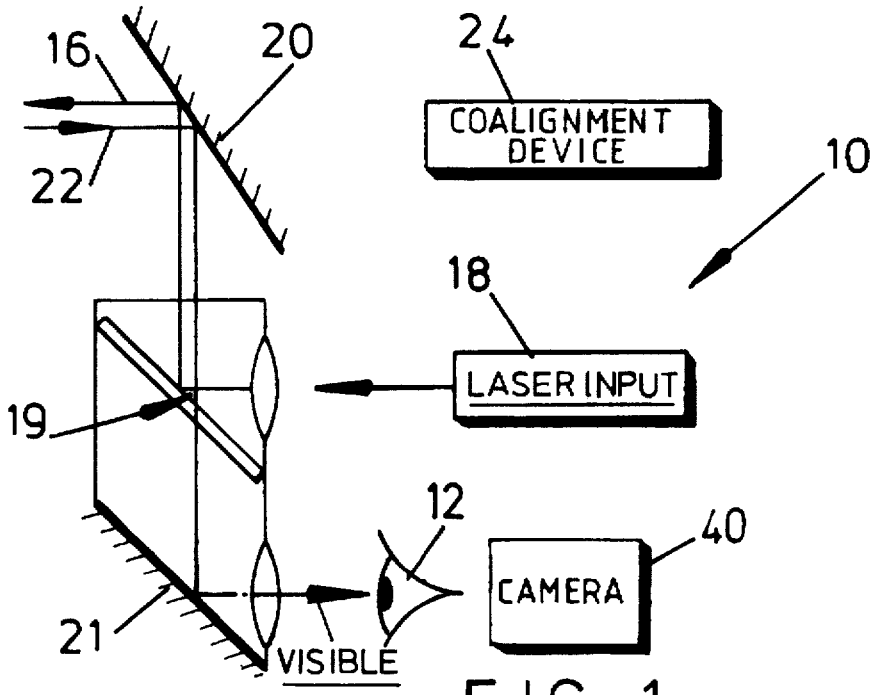
FIG. 1 is a schematic representation of a laser based missile sighting system incorporating apparatus for monitoring the coalignment of the sensor suite, in accordance with a preferred embodiment of the present invention.

Reference is first made to FIG. 1 of the drawings which illustrates, somewhat schematically, a laser based missile sighting system 10. The system includes an Nd: YAG laser 18, a beam splitter 19, two mirrors 20,21 and a coalignment device 24, all located within the protective casing (not shown) around the sighting system. In use, the user, represented by eye 12, sees a small spot aiming reference 14 (FIG. 2) produced by the beam 16 from the laser 18 impinging on a target. The spot is overlaid on the outside world scene which can be scanned using the steerable mirror 20. The returning part of the visible light created by reflection of the beam 16 from the target is indicated by line 22.

Figure 3:
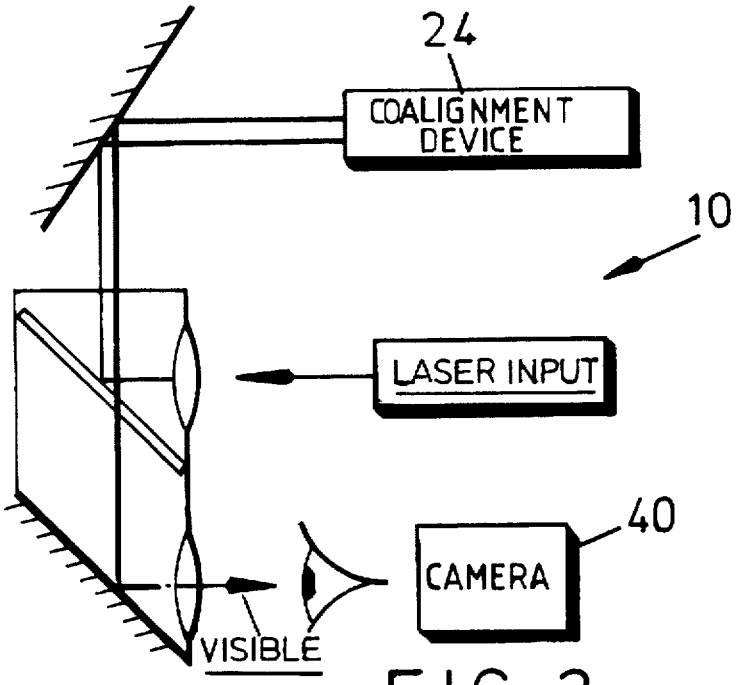
FIG. 3 shows the sighting system of FIG. 1, configured for determining coalignment.
Figure 4:
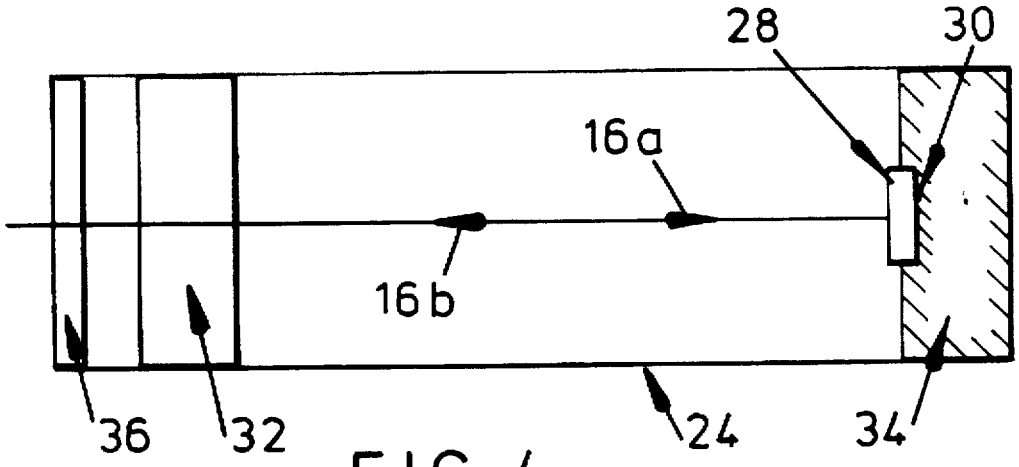
FIG. 4 is an enlarged view of the laser modifying device of the system of FIGS. 1 and 3.

To check the coalignment of the system 10, the mirror 20 is steered to the position as illustrated in FIG. 3 of the drawings, such that the user 12 is now viewing the coalignment device 24, as illustrated in greater detail in FIG. 4 of the drawings.

The principle of operation of the device 24 will first be described briefly, followed by a more detailed description of various aspects of the device 24.

Figure 2:
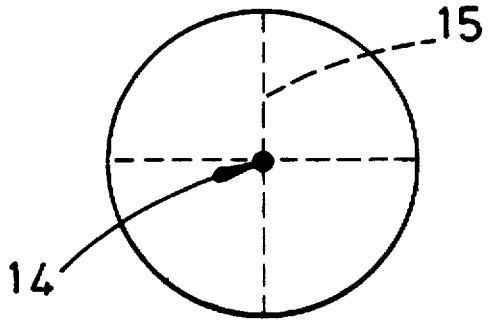
FIG. 2 shows the normal aiming reference of the sighting system of FIG. 1.

The laser energy 16*a* reflected by the mirror 20 enters the device 24 and is focused down into a specially processed zinc sulphide frequency doubling crystal 28. Conveniently, the crystal 28 is formed of Cleartran (trade name), produced by Morton International. The crystal 28 doubles the laser frequency and the 532 nm laser energy produced is reflected back off a mirrored surface 30 on the back of the doubling crystal 28. The returned laser energy 16*b* passes back through the device 24 and enters the sighting system as an image of a spot, apparently at infinity, or the point of focus of the sighting system. The image of the laser energy spot is seen by the operator 12 as a green flash which can then be aligned with respect to the cross-hairs 15 on the aiming reference (FIG. 2). This alignment can be accomplished in several ways: the input laser beam may be moved using steerable optical elements; the aiming reference image may be moved with respect to the outside world; or, in the case of a computerised system, the alignment error can be entered into the computer for automatic compensation.

The optics in the device 24 must be achromatic at the two wavelengths of interest, that is 1064 nm and 532 nm, in order to achieve good focus and alignment sensitivity. This is achieved in this embodiment through use of a doublet 32. The collection aperture of the device 24 is the full aperture of the beam 16*a* and is an f5 optical system and the frequency doubling crystal 28 is placed at the focal point of the incoming beam 16*a* such that the mirrored rear surface 30 is at the focal point of the laser. This ensures that the device is insensitive to tilt errors of the crystal 28 and acts only as a retro-reflector, such that no errors arising from manufacture of the device 24 are introduced into the coalignment of the sighting system.

The mirror coating 30 on the doubling crystal 28 is a monochromatic reflector designed such that only the 532 nm wavelength is reflected. The unconverted 1064 nm energy passes through the filter and is absorbed in the laser dump 34 in which the crystal 28 is positioned. Conveniently, the surface of the dump 34 is painted with Nextel to absorb any stray 1064 nm energy. As mentioned above, the preferred material for the doubling crystal 28 is Cleartran, which is specially processed zinc sulphide. Ordinary zinc sulphide generates significant dispersion of the returned signal, which would result in an almost lambertian light output. This would lead to a very large, ill-defined return spot, as well as loss of return energy/energy density. It has been found that the Cleartran crystal produces a well defined minimally scattered 532 nm return pulse exactly coaligned with the original input laser beam but, because of the mirrored surface 30, in the opposite direction. Beam vignetting is controlled by the alignment of the mirror surface tilt, but is not critical to successful operation.

The Cleartran crystal material also offers the advantage that it exhibits no polarisation sensitivity and has no critical thickness requirement; any polarisation state of laser energy can be input into the device 24 and still give successful results, and the crystal thickness may be made suitable for handling and ease of production, without concern for the conversion process, though if the material is too thin insufficient doubling occurs for the light to be visible.

The doubling process in the crystal 28 occurs when the electric field density generated by the focused laser energy is of the order of electric field strength of the material, this typically representing a significant laser energy density; approximately $10^7$ v/m is a typical electric field strength for most non-linear optical materials to begin to exhibit frequency doubling. The required energy density is less than the damage threshold of the Cleartran crystal 28, but any surface imperfections, particularly those at the mirror surface, at the focus of the laser, can result in lower damage thresholds.

A further consideration in the construction of the device 24 is the protection of the user 12; the 532 nm energy is laser light and mirrors exactly the input 1064 nm energy impulse duration. It is therefore necessary to restrict the amount or converted energy reaching the eye of the user to safe limits. In this example, the restriction is effected by reducing the amount of the 1064 nm laser energy entering the device 24 by using a KG5 glass plate 36 at the input to the device 24. At this location the light is in the form of a plane wavefront, such that the plate 36 does not affect the optical performance of the tool. As a secondary feature, any stray reflected 1064 nm energy will be attenuated by the plate 36 as it leaves the device 24, thus protecting the user from stray unconverted energy.

Thus, this embodiment of the present invention provides a relatively simple means of permitting coalignment of an Nd: YAG laser based direct view sighting system. It will be clear to those of skill in the art that the invention may be used in other forms of sighting system, one of which will now be described below.

In a CCD TV system a CCD camera 40 is provided at the image plane (in place of the eye 12 illustrated in FIGS. 1 and 3) and the aiming reference is shown to the operator on a suitable viewing screen. For a CCD system for use with an erbium glass laser operating at 1540 nm crystalline quartz is used as the doubling material. The wavelength (770) nm of the resulting laser energy is, approximately, the peak response wavelength of silicon CCD cameras which maximises system sensitivity to the laser spot.

The operation of a quartz-based system is the same as the Cleartran system described above, though the quartz is required to be more stringently dimensionally controlled and oriented with respect to the polarization orientation of the input laser.

Quartz was selected as the frequency doubling material for this application as it is readily and economically available, its parameters are well defined and it is insensitive to temperature change, an important feature in this design. However, the quartz crystal needs to be manufactured to very high optical standards of surface defect and impurity inclusions to prevent the laser energy "picking-up" on these sites and causing damage.

Further, the quartz component requires a tightly controlled thickness. To design a suitable frequency doubling target reference may be made to one of the relevant texts which will be familiar to those of skill in the art, such as The Elements of Non-Linear optics (Chapter 7.2.1), edited by P N Butcher & D Cotter (Cambridge University Press, ISBN 0-521-42424-0). However the governing equations are given below for reference:

$$I_{2\omega} = KI_{\omega}^2 \sin^2 \frac{z\pi}{l_c}$$

Where $I_{2\omega}$=irradiance of harmonic ($Wm^{-2}$)

$I_{\omega}$=irradiance of fundamental ($Wm^{-2}$)

K=constant

Z=crystal thickness $l_c$=coherence length $$l_c = \frac{\pi c}{2\omega|(n_{\omega} - n_{2\omega})|}$$

Where c=velocity of light

ω=optical frequency $n_{\omega}$=refractive index at fundamental frequency $n_{2\omega}$=refractive index at harmonic frequency $$K = \frac{2}{\epsilon_0 c^3} \frac{\omega^2 d^2}{n_{\omega}^2 n_{2\omega}} - \left(\frac{2l_c}{\pi}\right)^2$$

Where $\epsilon_0$=permittivity of free space d=second harmonic generation coefficient For an angular error of θ in alignment, $$I = I_{2\omega} \cos^2 \frac{\theta\pi}{180}$$

Where $I_{2\omega}$=intensity output for perfect alignment

In this case the 1540 nm energy is linearly polarised and thus using polarisation sensitive quartz requires that the crystal must be correctly orientated to the input laser beam. After frequency doubling the resultant 770 nm energy and 1540 nm energy have the same polarisation state. Polarisation sensitive devices cannot, therefore, be used to separate them.

We claim:

1. Apparatus for monitoring the coalignment of a sighting or surveillance suite including a laser and a sensor which are coaligned such that the image created by the beam from the laser impinging on an object is viewed by the sensor, the apparatus comprising: means for redirecting the beam from the laser; and means for (i) doubling the frequency of the redirected beam to produce a modified beam which is itself directly visible to the sensor and for (ii) directing the modified beam back to the means for redirecting in order to impinge on the sensor.

2. The apparatus of claim 1, wherein the doubling means is a doubling crystal.

3. The apparatus of claim 2, wherein the doubling crystal is processed zinc sulphide.

4. The apparatus of claim 2, wherein the doubling crystal is crystalline quartz.

5. The apparatus of claim 2, wherein the doubling crystal is provided with a mirrored rear surface.

6. The apparatus of claim 5, wherein the mirrored rear surface of the doubling crystal is located at the focal point of the incoming beam.

7. The apparatus of claim 6, wherein the mirrored surface is a monochromatic reflector and only reflects the modified laser beam.

8. The apparatus of claim 7, wherein a laser dump is located behind the mirrored surface to absorb any unreflected energy.

9. The apparatus of claim 1, for use in conjunction with a direct view sighting system, wherein the doubling means renders the laser beam visible to the human eye.

10. The apparatus of claim 1 including means for reducing the intensity of the laser beam.

11. The apparatus of claim 1 in combination with a sighting suite in the form of a direct view sighting system utilising an Nd:YAG laser, in which the beam from the laser is rendered visible the eye.

12. The apparatus of claim 1 in combination with a sighting suite in the form of a CCD camera system utilising an erbium glass laser, in which the beam from the laser is rendered visible to the camera.

* * * * *

UNITED STATES PATENT AND TRADEMARK OFFICE

CERTIFICATE OF CORRECTION

PATENT NO. : 5,786,889

DATED : July 28, 1998

INVENTOR(S) : Pope

It is certified that error appears in the above-identified patent and that said Letters Patent is hereby corrected as shown below:

On the Title page, item [56]:

In the References Cited, U.S. PATENT DOCUMENTS, insert missing references, --4,639,082 1/1987 Loy--, --5,054,917 10/1991 Pepin et al.--; FOREIGN PATENT DOCUMENTS, insert missing reference, --0179186 4/1986 EPO--.

Column 6, line 27, "the", first occurance, should be --an--; "the", second occurance, should be --a--; line 47, "claim 6" should be --claim 5--; line 61, after visible, insert --to--

Signed and Sealed this

Twenty-ninth Day of December, 1998

*Attest:*

*Attesting Officer*

Bruce Lehman

BRUCE LEHMAN

*Commissioner of Patents and Trademarks*